US011843164B2

(12) United States Patent
Konitzer

(10) Patent No.: US 11,843,164 B2
(45) Date of Patent: Dec. 12, 2023

(54) ANTENNA ASSEMBLY, VERTICAL TAIL, HORIZONTAL TAIL, WING, AIRCRAFT, AND METHOD

(71) Applicant: AIRBUS OPERATIONS GMBH, Hamburg (DE)

(72) Inventor: Peer Konitzer, Hamburg (DE)

(73) Assignee: Airbus Operations GmbH, Hamburg (DE)

( * ) Notice: Subject to any disclaimer, the term of this patent is extended or adjusted under 35 U.S.C. 154(b) by 147 days.

(21) Appl. No.: 17/427,287

(22) PCT Filed: Jun. 23, 2020

(86) PCT No.: PCT/EP2020/067547
§ 371 (c)(1),
(2) Date: Jul. 30, 2021

(87) PCT Pub. No.: WO2020/260311
PCT Pub. Date: Dec. 30, 2020

(65) Prior Publication Data

US 2022/0115777 A1 Apr. 14, 2022

(30) Foreign Application Priority Data

Jun. 28, 2019 (DE) ..... 10 2019 117 574.7

(51) Int. Cl.
*H01Q 1/28* (2006.01)
*H01Q 9/40* (2006.01)
(Continued)

(52) U.S. Cl.
CPC ..... *H01Q 1/287* (2013.01); *H01Q 9/40* (2013.01); *H01Q 21/293* (2013.01); *H01Q 1/40* (2013.01)

(58) Field of Classification Search
CPC ..... H01Q 1/287; H01Q 1/283; H01Q 1/40; H01Q 9/40; H01Q 21/293
See application file for complete search history.

(56) References Cited

U.S. PATENT DOCUMENTS 3,623,162 A 11/1971 Whitty
4,509,053 A 4/1985 Robin et al.
(Continued)

FOREIGN PATENT DOCUMENTS

CN 110190379 A * 8/2019 ..... H01Q 1/48
EP 2 899 119 7/2015
(Continued)

OTHER PUBLICATIONS

International Search Report for PCT/EP2020/067547, dated Sep. 29, 2020, 4 pages.
(Continued)

*Primary Examiner* — Hoang V Nguyen
(74) *Attorney, Agent, or Firm* — Nixon & Vanderhye P.C.

(57) ABSTRACT

An elongate antenna assembly (1) for an aircraft including a structural section (3) and an antenna element (5), wherein the structural section (3) includes an elongate leading edge section (7) extending in a longitudinal direction (13) of the antenna assembly, a first lateral section (9), and a second lateral section (11), wherein the leading edge section (7) is curved such that the leading edge section (7) comprises a convex outer surface (15) extending in the longitudinal direction (13) of the antenna assembly (1) on a convex side (19) of the antenna assembly.

17 Claims, 4 Drawing Sheets

(51) Int. Cl.
*H01Q 21/29* (2006.01)
*H01Q 1/40* (2006.01)

(56) References Cited

U.S. PATENT DOCUMENTS

| | | | |
|---|---|---|---|
| 5,225,844 | A | 7/1993 | Williams |
| 6,638,466 | B1 | 10/2003 | Abbott |
| 7,737,898 | B2 | 6/2010 | Hanusa et al. |
| 2011/0095951 | A1 | 4/2011 | McCarthy et al. |
| 2018/0320767 | A1 | 11/2018 | Crine et al. |

FOREIGN PATENT DOCUMENTS

| | | |
|---|---|---|
| EP | 3 357 808 | 8/2018 |
| EP | 3 575 203 | 12/2019 |

OTHER PUBLICATIONS

Written Opinion of the ISA for PCT/EP2020/067547, dated Sep. 29, 2020, 11 pages.

* cited by examiner

ANTENNA ASSEMBLY, VERTICAL TAIL, HORIZONTAL TAIL, WING, AIRCRAFT, AND METHOD

RELATED APPLICATIONS

This application is the U.S. national phase of International Application PCT/EP2020/067547 filed Jun. 23, 2020, which designated the U.S. and claims priority to German patent application DE 10 2019 117 574.7 filed Jun. 28, 2019, the entire contents of each of which are hereby incorporated by reference.

BACKGROUND

The invention relates to an antenna assembly for an aircraft, a vertical tail, a horizontal tail, a wing, an aircraft, and a method.

Aircrafts typically have one or more antennas through which a radio link can be established between the aircraft and external devices or participants on the ground or in the air, such as other aircrafts or satellites. These antennas can be mounted to the outer surface of an aircraft such that the antennas extend into the ambient air of the aircraft, increase the air drag and increase the associated fuel costs during operation of the aircraft. Further, these antennas can be mounted in an interior space of the aircraft, where the antennas are surrounded by aircraft structures. Since the antenna element needs to emit and/or receive radio waves to/from the surrounding of the aircraft, the radio waves need to pass through the aircraft structures, which may lead to a limited selection of geometries and materials used for these aircraft structures, which can lead to an increased weight of the aircraft. Further, it is generally desirable to reduce the assembly time of an aircraft.

SUMMARY

An object of the present invention is to provide an antenna assembly, which, when used as an antenna assembly for an aircraft, reduces the assembly time of the aircraft, reduces the weight of the aircraft, and reduces the air drag and the associated fuel costs during operation of the aircraft.

According to a first aspect of the present invention, the object is solved by an elongate antenna assembly comprising the features of claim 1. The antenna assembly is configured for an aircraft. The antenna assembly comprises a structural section and an antenna element. The structural section comprises an elongate leading edge section. The leading edge section extends in a longitudinal direction of the antenna assembly. The structural section comprises a first lateral section and a second lateral section. The leading edge section is curved such that the leading edge section comprises a convex outer surface extending in the longitudinal direction of the antenna assembly on a convex side of the antenna assembly. The first lateral section extends away from the leading edge section on a first side of the leading edge section in a first direction transverse to the longitudinal direction of the antenna assembly. The second lateral section extends away from the leading edge section on a second side of the leading edge section opposite the first side of the leading edge section in a second direction transverse to the longitudinal direction of the antenna assembly. An elongate first recess is formed in the leading edge section on the convex side of the antenna assembly. The first recess extends in the longitudinal direction of the antenna assembly. An elongate first section of the antenna element extends in the longitudinal direction of the antenna assembly. The elongate first section of the antenna element is arranged in the first recess, such that an outer surface of the elongate first section of the antenna element and the convex outer surface of the leading edge section form a first surface of the antenna assembly on the convex side of the antenna assembly.

The antenna assembly is configured for an aircraft. The antenna assembly is configured to be mountable to a remaining section of the aircraft to form the aircraft or a section of the aircraft. For example, the antenna assembly, or at least a section of the antenna assembly, may form a section of a leading edge of a vertical tail for an aircraft. Further, the antenna assembly, or at least a section of the antenna assembly, may form a section of a leading edge of a horizontal tail for an aircraft. In addition, the antenna assembly, or at least a section of the antenna assembly, may form a section of a leading edge of a wing for an aircraft.

The antenna assembly comprises the structural section. It is preferred that the structural section is formed as a single element. Alternatively, the structural section may comprise an array of several separate elements, which are mounted to each other to form the structural section. For example, the leading edge section, the first lateral section, and the second lateral section form a single element. Alternatively, the leading edge section, the first lateral section, and the second lateral section may form separate elements and may be mounted to each other to form the structural section. The structural section may be mountable to a front spar of an aircraft. For example, the structural section is mountable to a front spar of a vertical tail for an aircraft. Further, the structural section may be mountable to a front spar of a horizontal tail for an aircraft. In addition, the structural section may be mountable to a front spar of a wing for an aircraft.

The antenna assembly comprises the antenna element. The antenna element may be formed as a single antenna element to emit and/or receive radio waves. Alternatively, the antenna element may comprise an array of several separate antenna elements, which interact with each other to emit and/or receive radio waves. For example, the antenna element may comprise a first section, a second section, a third section, and a fourth section. The fourth section may also be referred to as a second connecting element of the antenna element. The first section, the second section, the third section, and the fourth section may together form the single antenna element. Alternatively, the antenna element may comprise the first section, the second section, the third section, and the fourth section, which form the array of several separate antenna elements, which interact with each other to emit and/or receive radio waves. Each of the first section, the second section, the third section, and the fourth section may be arranged in a respective recess, which may be formed in the leading edge section and/or in the first lateral section such that a respective outer surface of the first section, the second section, the third section, and the fourth section forms at least a respective section of a total outer surface of the antenna assembly comprising a shape similar to a shape of known leading edge surfaces of aircrafts. In particular, it is preferred that the antenna element comprises or is formed of a metal to guide electromagnetic waves.

The structural section comprises the elongate leading edge section. Preferably, when the antenna assembly is mounted to a remaining section of the aircraft to form the aircraft or a section of the aircraft, the leading edge section of the structural section is arranged in front of the remaining section of the structural section in a flight direction of the aircraft. In other words, the leading edge section points in the flight direction of the aircraft, when the antenna assembly is mounted to a remaining section of the aircraft to form the aircraft. The leading edge section is elongate such that a longitudinal extension of the leading edge section is larger than a transverse extension of the leading edge section.

The leading edge section extends in the longitudinal direction of the antenna assembly. Preferably, the leading edge section extends along its longitudinal extension in the longitudinal direction of the antenna assembly. Particularly, when the antenna assembly is mounted to a remaining section of the aircraft to form the aircraft or a section of the aircraft, the longitudinal direction of the antenna assembly and the flight direction of the aircraft are oriented transversely to each other.

The structural section comprises the first lateral section and the second lateral section. Preferably, when the antenna assembly is mounted to a remaining section of the aircraft to form the aircraft or a section of the aircraft, the first lateral section is arranged behind the leading edge section in a flight direction of the aircraft. Similarly, it is preferred that when the antenna assembly is mounted to a remaining section of the aircraft to form the aircraft or a section of the aircraft, the second lateral section is arranged behind the leading edge section in a flight direction of the aircraft. The first lateral section and the second lateral section may each be configured to be mountable to a front spar of an aircraft, such as a front spar of a vertical tail, a front spar of a horizontal tail, or a front spar of a wing.

The leading edge section is curved such that the leading edge section comprises the convex outer surface extending in the longitudinal direction of the antenna assembly on the convex side of the antenna assembly. Due to the leading edge section being curved, two opposite sides of the antenna assembly can be referred to as the convex side of the antenna assembly and the concave side of the antenna assembly, respectively. Especially, the convex side of the antenna assembly is on the same side of the antenna assembly as the convex outer surface of the leading edge section. Further, the concave side of the antenna assembly is preferably on the side of the antenna assembly opposite the convex outer surface of the leading edge section. Preferably, the convex outer surface of the leading edge section comprises a curved shape with radii of curvature along the longitudinal direction, when represented as vectors, being oriented perpendicular to the longitudinal direction of the antenna assembly. It is preferred that when the antenna assembly is mounted to a remaining section of the aircraft to form the aircraft or a section of the aircraft, the convex side of the antenna assembly is arranged in front of the concave side of the antenna assembly in the flight direction of the aircraft.

The first lateral section extends away from the leading edge section on the first side of the leading edge section in the first direction transverse to the longitudinal direction of the antenna assembly. Preferably, the first lateral section is elongate and extends in the longitudinal direction of the antenna assembly, preferably parallel to the leading edge section. The second lateral section extends away from the leading edge section on the second side of the leading edge section opposite the first side of the leading edge section in the second direction transverse to the longitudinal direction of the antenna assembly. Preferably, the second lateral section is elongate and extends in the longitudinal direction of the antenna assembly, preferably parallel to the leading edge section. The first direction and the second direction may be oriented transversely to each other, such that an outer surface of the first lateral section and the outer surface of the second lateral section form a section of the total outer surface of the antenna assembly with an advantageous aerodynamic shape.

The elongate first recess is formed in the leading edge section on the convex side of the antenna assembly. The first recess is elongate such that a longitudinal extension of the first recess is larger than a transverse extension of the first recess. Preferably, since the first recess is formed in the leading edge section on the convex side of the antenna assembly, the recess faces the flight direction when the antenna assembly is mounted to a remaining section of the aircraft to form the aircraft or a section of the aircraft.

The first recess extends in the longitudinal direction of the antenna assembly. Preferably, the first recess extends along its longitudinal extension in the longitudinal direction of the antenna assembly.

The elongate first section of the antenna element extends in the longitudinal direction of the antenna assembly. Since the first recess and the first section of the antenna element extend both in the longitudinal direction of the antenna assembly, the first recess and the first section can be arranged parallel to each other in the longitudinal direction of the antenna assembly and thereby transvers to the flight direction of the aircraft when the antenna assembly is mounted to a remaining section of the aircraft to form the aircraft or a section of the aircraft.

The elongate first section of the antenna element is arranged in the recess, such that the outer surface of the elongate first section of the antenna element and the convex outer surface of the leading edge section form the first surface of the antenna assembly on the convex side of the antenna assembly. Since the elongate first section of the antenna element is arranged in the recess, which is formed in the leading edge section on the convex side of the antenna assembly, the elongate first section of the antenna element is arranged in front of the structural section in the flight direction of the aircraft when the antenna assembly is mounted to a remaining section of the aircraft to form the aircraft or a section of the aircraft. Due to the arrangement of the elongate first section of the antenna element in front of the structural section in the flight direction of the aircraft, the elongate first section of the antenna element can provide an erosion protection for the structural section of the antenna assembly. By providing the erosion protection, the antenna element can protect the structural section from punctures, tearing and abrasion. Since the antenna element can provide the erosion protection for the structural section of the antenna assembly, no erosion protection elements as known from the prior art are needed or at least the amount of erosion protection elements used to protect the leading edge structures of the aircraft can be significantly reduced. Since the antenna element provides the erosion protection for the structural section of the antenna element, the number of components of the aircraft can be reduced, which in turn reduces the assembly time of the aircraft.

Further, since the elongate first section of the antenna element is arranged in the recess, which is formed on the convex side of the antenna assembly, the first section of the antenna element is preferably arranged on the convex side of the antenna assembly with respect to the structural section. The arrangement of the first section of the antenna element on the convex side of the antenna assembly with respect to the structural section ensures that the antenna element can emit and/or receive radio waves to/from the surrounding of the antenna assembly without them having to pass through the structural section of the antenna assembly. Therefore, a wide selection of geometries and materials can be used for the structural section such that the weight of the aircraft can be reduced.

The outer surface of the elongate first section of the antenna element and the convex outer surface of the leading edge section form the first surface of the antenna assembly on the convex side of the antenna assembly. Preferably, the outer surface of the elongate first section of the antenna element is convex such that a convex side of the first section of the antenna element is the convex side of the antenna assembly. The first surface of the antenna assembly on the convex side of the antenna assembly is preferably oriented in the flight direction of the aircraft when the antenna assembly is mounted to a remaining section of the aircraft to form the aircraft or a section of the aircraft. It is preferred that the first surface of the antenna assembly on the convex side of the antenna assembly is a continuous, smooth surface with an advantageous aerodynamic shape and forms at least a section of the total outer surface of the antenna assembly comprising a shape similar to a shape of known leading edge surfaces of aircrafts. Therefore, a reduction in air drag and associated savings in fuel costs are achieved during operation of the aircraft.

In summary, an antenna assembly is provided, which, when used as an antenna assembly for an aircraft, reduces the assembly time of the aircraft, reduces the weight of the aircraft, and reduces the air drag and the associated fuel costs during operation of the aircraft.

According to a preferred embodiment of the antenna assembly, the first recess is formed in the leading edge section on the convex side of the antenna assembly such that at least a section of the leading edge section is arranged between the elongate first section of the antenna element and a concave side of the antenna assembly opposite the convex side of the antenna assembly. The section of the leading edge section arranged between the elongate first section of the antenna element and the concave side of the antenna assembly can provide a mechanical support for the first section of the antenna element from the concave side of the antenna assembly. Further, the first section of the antenna element can provide an erosion protection for the section of the leading edge section arranged between the elongate first section of the antenna element and the concave side of the antenna assembly.

According to a preferred embodiment of the antenna assembly, the antenna element comprises an inner section, which is arranged on the concave side of the antenna assembly opposite the convex side of the antenna assembly, wherein the elongate first section of the antenna element and the inner section of the antenna element are electrically connected to each other via a first connecting element, wherein the first connecting element is arranged in a first opening formed in the structural section. The first section of the antenna element can form an external antenna part of the antenna element and the inner section of the antenna element can form an internal antenna part of the antenna element, wherein the external antenna part and the internal antenna part are electrically connected to each other via the first connecting element. Different arrangements and geometries of the first section and the inner section are possible depending on the desired characteristics of the antenna element.

According to a preferred embodiment of the antenna assembly, an elongate second recess is formed in the first lateral section, wherein the second recess extends in the longitudinal direction of the antenna assembly, wherein an elongate second section of the antenna element extends in the longitudinal direction of the antenna assembly and is arranged in the second recess, such that an outer surface of the elongate second section of the antenna element and an outer surface of the first lateral section form a second surface of the antenna assembly. The second recess is elongate such that a longitudinal extension of the second recess is larger than a transverse extension of the second recess. Preferably, the second recess is formed in the first lateral section on the convex side of the antenna assembly. Preferably, the second recess faces transverse to the flight direction when the antenna assembly is mounted to a remaining section of the aircraft to form the aircraft or a section of the aircraft. Preferably, the second recess extends along its longitudinal extension in the longitudinal direction of the antenna assembly. Since the second recess and the second section of the antenna element can both extend in the longitudinal direction of the antenna assembly, the second recess and the second section can be arranged parallel to each other in the longitudinal direction of the antenna assembly and thereby transvers to the flight direction of the aircraft when the antenna assembly is mounted to a remaining section of the aircraft to form the aircraft or a section of the aircraft.

The elongate second section of the antenna element is arranged in the second recess, such that the outer surface of the elongate second section of the antenna element and the outer surface of the first lateral section form the second surface of the antenna assembly. It is preferred that the outer surface of the second section of the antenna element is convex such that a convex side of the second section of the antenna element is the convex side of the antenna assembly. Further, it is preferred that the outer surface of the first lateral section is convex such that a convex side of the first lateral section is the convex side of the antenna assembly. Moreover, it is preferred that the second surface of the antenna assembly on the convex side of the antenna assembly is a continuous, smooth surface with an advantageous aerodynamic shape and forms at least a section of the total outer surface of the antenna assembly comprising a shape similar to a shape of known leading edge surfaces of aircrafts.

According to a preferred embodiment of the antenna assembly, the first section of the antenna element and the second section of the antenna element are electrically connected to each other via a second connecting element of the antenna element. The second connecting element may be arranged in a respective recess, which may be formed in the leading edge section and/or in the first lateral section such that an outer surface of the second connecting element forms at least a section of the total outer surface of the antenna assembly comprising a shape similar to a shape of known leading edge surfaces of aircrafts.

According to a preferred embodiment of the antenna assembly, the length of the antenna element from a first end of the antenna element to a second end of the antenna element is 5 meters. A length of 5 meters of the antenna element is a beneficial feature of the antenna element for emitting and/or receiving radio waves.

According to a preferred embodiment of the antenna assembly, the cross sectional area of the antenna element along the length of the antenna element from a first end of the antenna element to a second end of the antenna element is at least 20 square millimeters. A cross sectional area of the antenna element of at least 20 square millimeters is a beneficial feature of the antenna element for emitting and/or receiving radio waves.

According to a preferred embodiment of the antenna assembly, the antenna assembly comprises at least one terminal, wherein the at least one terminal is electrically connected to the antenna element for an electrical connection between the antenna element and an external unit. Preferably, the unit can comprise transmission and/or reception electronics, which transmit and receive radio signals with the aid of the antenna element. If a terminal is provided, the terminal can be provided or mounted to the structural section. The terminal can be a standard antenna terminal, thus providing a standard interface for connection the antenna element to on-board electronics of the aircraft, irrespective of the precise type of the antenna element.

According to a preferred embodiment of the antenna assembly, the antenna assembly comprises a second opening formed in the structural section, wherein the second opening extends from an outer surface of the antenna assembly to an inner surface of the antenna assembly, wherein a third connecting element is arranged in the second opening, wherein the third connecting element is electrically connected to the antenna element. Since the third connecting element is arranged in the second opening, which extends from the outer surface of the antenna assembly to the inner surface of the antenna assembly, a component arranged on the concave side of the antenna assembly can be electrically connected to the antenna element.

According to a preferred embodiment of the antenna assembly, the structural section comprises a first skin, a second skin, and a core, wherein the first skin is attached to the core on a first side of the core and the second skin is attached to the core on a second side of the core opposite the first side of the core, wherein at least a section of the first skin forms at least a section of the convex outer surface of the leading edge section. Preferably, the first skin, the second skin, and the core form a sandwich structured composite, which provides a light weight and high strength structural section.

According to a preferred embodiment of the antenna assembly, the structural section comprises a glass fiber reinforced polymer structure. The structural section can comprise or can be formed of the glass fiber reinforced polymer structure. By using the glass fiber reinforced polymer structure, the structural section becomes a light weight and high strength structural section.

According to a preferred embodiment of the antenna assembly, the structural section comprises a carbon fiber reinforced polymer structure. The structural section can comprise or can be formed of the carbon fiber reinforced polymer structure. By using the carbon fiber reinforced polymer structure, the structural section becomes a light weight and high strength structural section.

According to a second aspect of the present invention, the object is also solved by a vertical tail for an aircraft comprising the features of claim 13. The vertical tail comprises an antenna assembly according to the first aspect of the present invention. The first section of the antenna element forms a section of a leading edge of the vertical tail. The vertical tail is configured for an aircraft such that the vertical tail is mountable to a remaining section of the aircraft to form the aircraft. The features, technical effects and/or advantages described in connection with the first aspect, the third aspect, the fourth aspect, the fifth aspect, and the sixth aspect of the present invention also apply to the second aspect of the present invention at least in an analogous manner, so that no corresponding repetition is made here.

According to a third aspect of the present invention, the object is also solved by a horizontal tail for an aircraft comprising the features of claim 14. The horizontal tail comprises an antenna assembly according to the first aspect of the present invention. The first section of the antenna element forms a section of a leading edge of the horizontal tail. The horizontal tail is configured for an aircraft such that the horizontal tail is mountable to a remaining section of the aircraft to form the aircraft. The features, technical effects and/or advantages described in connection with the first aspect, the second aspect, the fourth aspect, the fifth aspect, and the sixth aspect of the present invention also apply to the third aspect of the present invention at least in an analogous manner, so that no corresponding repetition is made here.

According to a fourth aspect of the present invention, the object is also solved by a wing for an aircraft comprising the features of claim 15. The wing comprises an antenna assembly according to the first aspect of the present invention. The first section of the antenna element forms a section of a leading edge of the wing. The wing is configured for an aircraft such that the wing is mountable to a remaining section of the aircraft to form the aircraft. The features, technical effects and/or advantages described in connection with the first aspect, the second aspect, the third aspect, the fifth aspect, and the sixth aspect of the present invention also apply to the fourth aspect of the present invention at least in an analogous manner, so that no corresponding repetition is made here.

According to a fifth aspect of the present invention, the object is also solved by an aircraft comprising the features of claim 16. The aircraft comprises a vertical tail according to the second aspect of the present invention and/or a horizontal tail according to the third aspect of the present invention and/or a wing according to the fourth aspect of the present invention. The features, technical effects and/or advantages described in connection with the first aspect, the second aspect, the third aspect, the fourth aspect, and the sixth aspect of the present invention also apply to the fifth aspect of the present invention at least in an analogous manner, so that no corresponding repetition is made here.

According to a sixth aspect of the present invention, the object is also solved by a method comprising the features of claim 17. The method is provided for manufacturing an antenna assembly according to the first aspect of the present invention. The method comprises providing a preform and the antenna element. The method further comprises positioning the preform and the antenna element relative to each other such that the antenna element is arranged in a recess of the preform. In addition, the method comprises heating the preform and the antenna element from a first temperature to a second temperature above a curing temperature of the preform to form the antenna assembly from the preform and the antenna element. The features, technical effects and/or advantages described in connection with the first aspect, the second aspect, the third aspect, the fourth aspect, and the fifth aspect of the present invention also apply to the sixth aspect of the present invention at least in an analogous manner, so that no corresponding repetition is made here. Even though the method steps are described in a certain order, the present invention is not restricted to this order. Rather, the individual method steps can be carried out in any meaningful sequence.

Further features, advantages and application possibilities of the present invention may be derived from the following description of exemplary embodiments and/or the figures. Thereby, all described and/or visually depicted features for themselves and/or in any combination may form an advantageous subject matter and/or features of the present invention independent of their combination in the individual claims or their dependencies. Furthermore, in the figures, same reference signs may indicate same or similar objects.

DETAILED DESCRIPTION

Figure 1:
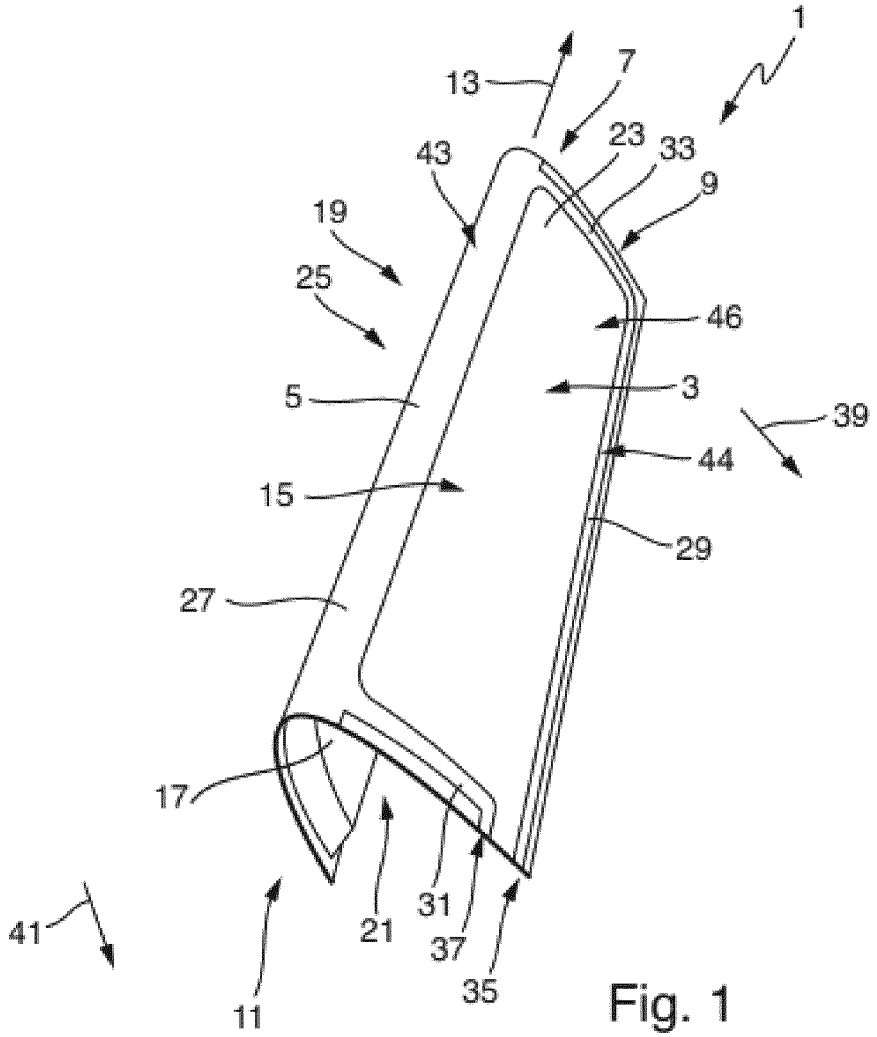
FIG. 1 schematically illustrates a first embodiment of an elongate antenna assembly with a first embodiment of a structural section and a first embodiment of an antenna element.

FIG. 1 schematically illustrates a first embodiment of an elongate antenna assembly 1 with a structural section 3 and an antenna element 5. The structural section 3 comprises an elongate leading edge section 7, a first lateral section 9, and a second lateral section 11. The structural section 3 comprises a carbon fiber reinforced polymer structure. Additionally or alternatively, the structural section 3 can also comprise a glass fiber reinforced polymer structure.

The leading edge section 7 extends in a longitudinal direction 13 of the antenna assembly 1. The leading edge section 7 is curved such that the leading edge section 7 comprises a convex outer surface 15 and a concave inner surface 17. The convex outer surface 15 extends in the longitudinal direction 13 of the antenna assembly 1 on a convex side 19 of the antenna assembly. The concave inner surface 17 extends in the longitudinal direction 13 of the antenna assembly 1 on a concave side 21 of the antenna assembly 1 opposite the convex side 19 of the antenna assembly.

The leading edge section 7 comprises a first side 23 and a second side 25 opposite the first side 23. The first lateral section 9 extends away from the leading edge section 7 on the first side 23 of the leading edge section 7 in a first direction 39 transverse to the longitudinal direction 13 of the antenna assembly. The second lateral section 11 extends away from the leading edge section 7 on the second side 25 of the leading edge section 7 in a second direction 41 transverse to the longitudinal direction 13 of the antenna assembly.

The antenna element 5 comprises a first section 27, a second section 29, a third section 31, and a fourth section 33. The first section 27 and the second section 29 are both elongate and extend both in the longitudinal direction 13. The first section 27 is electrically connected to the second section 29 via the fourth section 33, which can also be referred to as second connecting element of the antenna element 5. The first section 27 is electrically connected to the third section 31. The length of the antenna element 5 from a first end 35 of the antenna element 5 to a second end 37 of the antenna element 5 is 5 meters. Further, the cross sectional area of the antenna element 5 along the length of the antenna element 5 from the first end 35 of the antenna element 5 to the second end 37 of the antenna element 5 is at least 20 square millimeters. The cross sectional area of the antenna element 5 in the first section 27 and in the second section 29 is arranged perpendicular to the longitudinal direction 13. Further, the cross sectional area of the antenna element 5 in the third section 31 and in the fourth section 33 is arranged perpendicular to a first direction 39 transverse to the longitudinal direction 13. In addition to the first direction 39, a second direction 41 is shown in FIG. 1. The second direction 41 is oriented transverse to the longitudinal direction 13. The antenna assembly 1 comprises a first terminal and a second terminal. The first terminal is electrically connected to the first end 35 of the antenna element 5 and the second terminal is connected to the second end 37 of the antenna element 5 for an electrical connection between the antenna element 5 and an external unit.

A first recess is formed in the leading edge section 7, wherein the first section 27 of the antenna element 5 is arranged in the first recess. The first recess is formed in the leading edge section 7 on the convex side 19 of the antenna assembly 1 such that at least a section of the leading edge section 7 is arranged between the elongate first section 27 of the antenna element 5 and the concave side 21 of the antenna assembly. The first recess cannot be seen in FIG. 1, since the first recess is completely covered by the first section 27 of the antenna element 5.

Additionally, a second recess is formed in the first lateral section 9, wherein the second section 29 of the antenna element 5 is arranged in the second recess. The second recess is formed in the first lateral section 9 on the convex side 19 of the antenna assembly 1 such that at least a section of the first lateral section 9 is arranged between the second section 29 of the antenna element 5 and the concave side 21 of the antenna assembly. The second recess cannot be seen in FIG. 1, since the second recess is completely covered by the second section 29 of the antenna element 5.

The first recess and the second recess are both elongate and extend both in the longitudinal direction 13 of the antenna assembly. Similarly, the first section 27 of the antenna element 5 and the second section 29 of the antenna element 5 are both elongate and extend both in the longitudinal direction 13 of the antenna assembly. The first recess, the second recess, the first section 27 of the antenna element 5, and the second section 29 of the antenna element 5 are all arranged on the convex side 19 of the antenna assembly.

The first section 27 of the antenna element 5 is arranged in the first recess and the second section 29 of the antenna element 5 is arranged in the second recess. An outer surface 43 of the first section 27 of the antenna element 5 and the convex outer surface 15 of the leading edge section 7 form a first surface of the antenna assembly 1 on the convex side 19 of the antenna assembly. Similarly, an outer surface 44 of the second section 29 of the antenna element 5 and an outer surface 46 of the first lateral section 9 form a second surface of the antenna assembly 1 on the convex side 19 of the antenna assembly. The first surface and the second surface form a section of a total outer surface of the antenna assembly.

Figure 2:
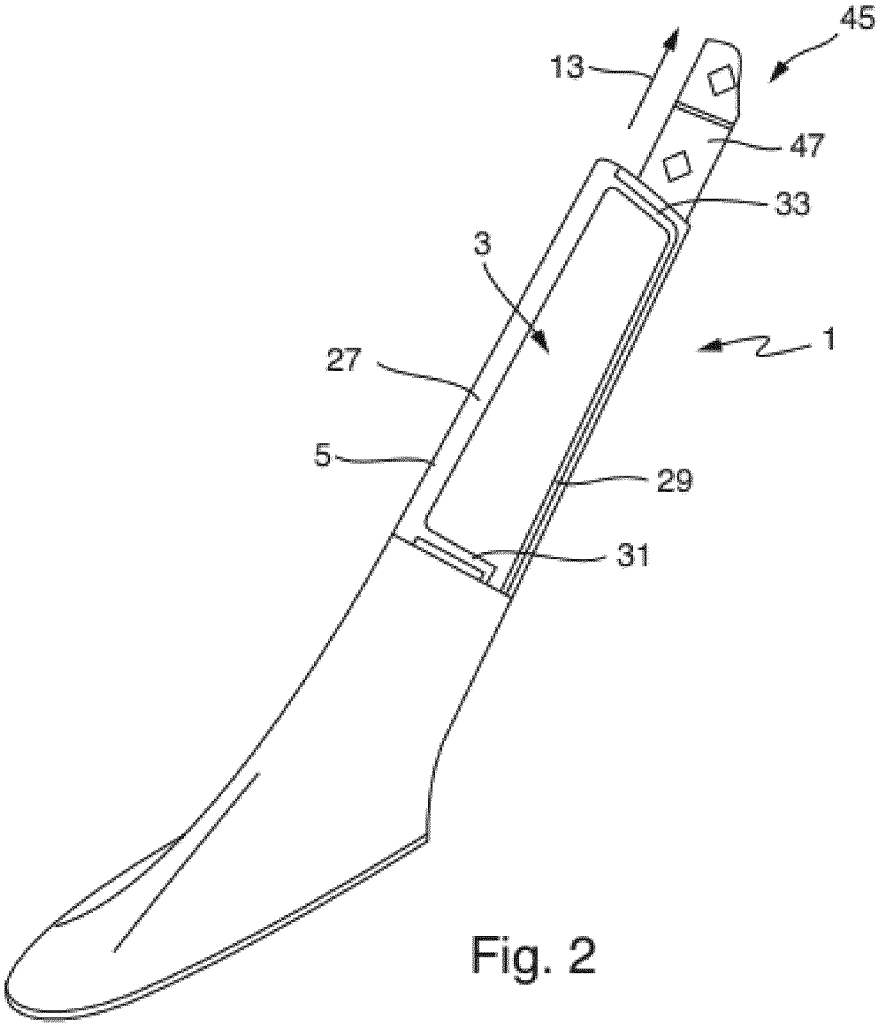
FIG. 2 schematically illustrates a section of a first embodiment of a vertical tail for an aircraft comprising the first embodiment of the elongate antenna assembly shown in FIG. 1.

FIG. 2 schematically illustrates a section of a first embodiment of a vertical tail 45 for an aircraft comprising the first embodiment of the elongate antenna assembly 1 shown in FIG. 1. The antenna assembly 1 is mounted to a front spar 47 of the vertical tail 45. The first section 27 of the antenna element 5 forms a section of a leading edge of the vertical tail 45. Similar to FIG. 2, a horizontal tail for an aircraft can comprise the first embodiment of the elongate antenna assembly 1 shown in FIG. 1. In this case, the first section 27 of the antenna element 5 forms a section of a leading edge of the horizontal tail. Further, a wing for an aircraft can comprise the first embodiment of the elongate antenna assembly 1 shown in FIG. 1. In this case, the first section 27 of the antenna element 5 forms a section of a leading edge of the wing. Each of the vertical tail 45, the horizontal tail, and the wing can be mounted to an aircraft, such that the aircraft comprises the vertical tail 45 and/or the horizontal tail and/or the wing according.

Figure 3:
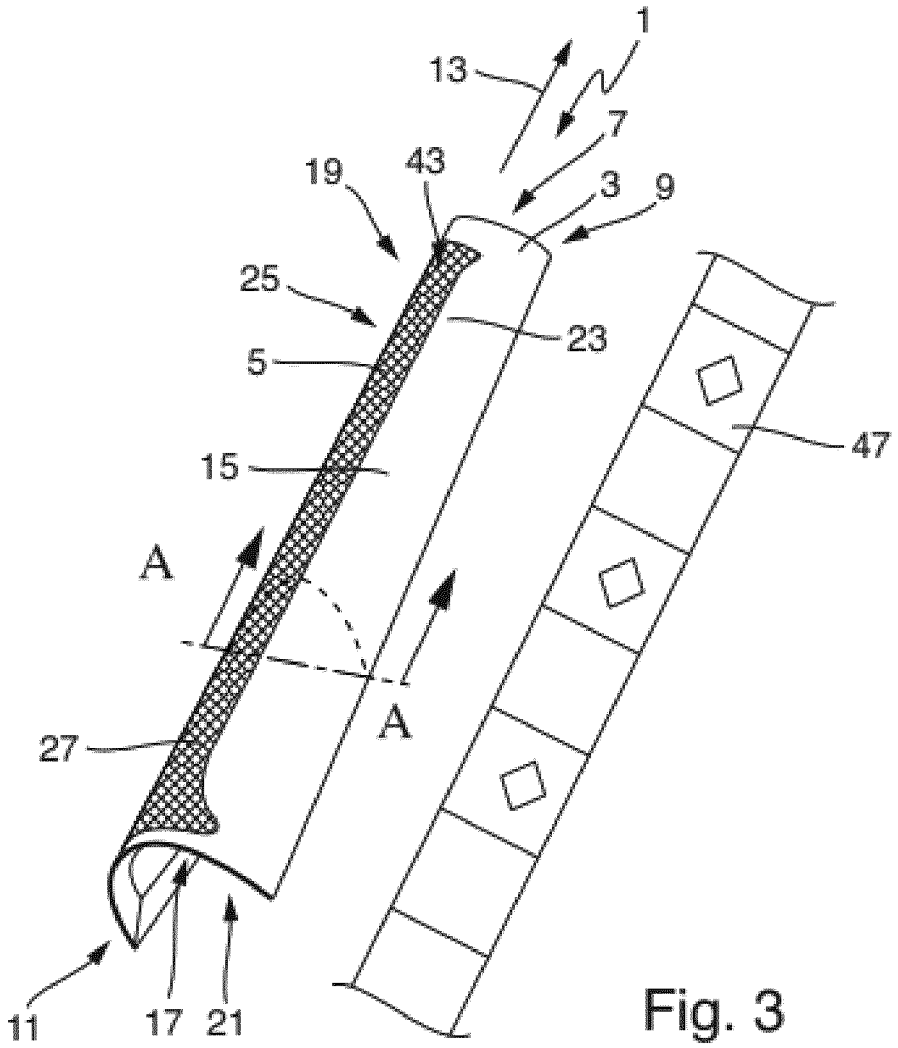
FIG. 3 schematically illustrates a second embodiment of the elongate antenna assembly with a second embodiment of the structural section and a second embodiment of the antenna element and a front spar of a vertical tail for an aircraft.

FIG. 3 schematically illustrates a second embodiment of the elongate antenna assembly 1 with a second embodiment of the structural section 3 and a second embodiment of the antenna element 5 and a front spar 47 of a vertical tail for an aircraft. The antenna element 5 comprises the first section 27. A first recess is formed in the leading edge section 7 of the structural section 3, wherein the first section 27 of the antenna element 5 is arranged in the first recess. The first recess is formed in the leading edge section 7 on the convex side 19 of the antenna assembly 1 such that at least a section of the leading edge section 7 is arranged between the elongate first section 27 of the antenna element 5 and the concave side 21 of the antenna assembly. The first recess cannot be seen in FIG. 3, since the first recess is completely covered by the first section 27 of the antenna element 5. The first recess is elongate and extends in the longitudinal direction 13 of the antenna assembly. Similarly, the first section 27 of the antenna element 5 is elongate and extends in the longitudinal direction 13 of the antenna assembly. The first recess and the first section 27 of the antenna element 5 are both arranged on the convex side 19 of the antenna assembly. The first section 27 of the antenna element 5 is arranged in the first recess, such that an outer surface 43 of the first section 27 of the antenna element 5 and the convex outer surface 15 of the leading edge section 7 form a first surface of the antenna assembly 1 on the convex side 19 of the antenna assembly. The first surface forms a section of the total outer surface of the antenna assembly.

Figure 4:
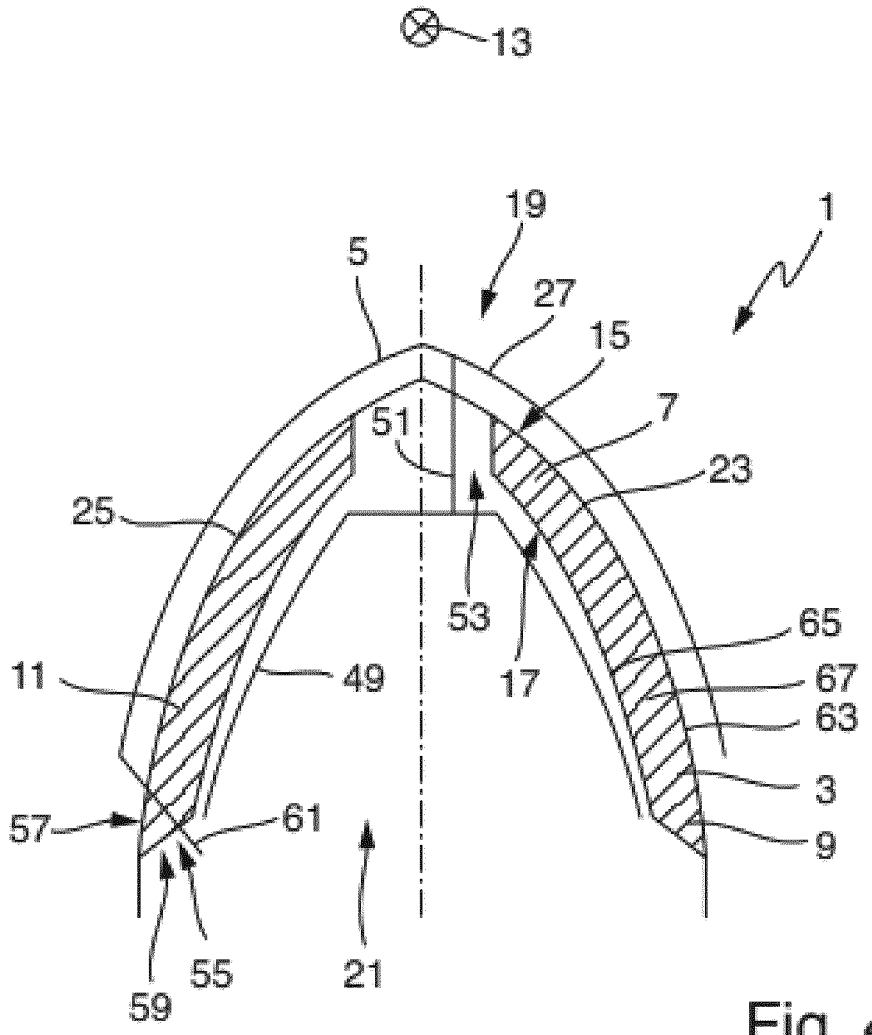
FIG. 4 schematically illustrates a cross section of a third embodiment of the elongate antenna assembly with a third embodiment of the structural section and a third embodiment of the antenna element.

FIG. 4 schematically illustrates a cross section of a third embodiment of the elongate antenna assembly 1 with a third embodiment of the structural section 3 and a third embodiment of the antenna element 5. FIG. 4 illustrates the third embodiment of the elongate antenna assembly 1 and FIG. 3 illustrates the second embodiment of the elongate antenna assembly 1. The line A-A in FIG. 3 illustrates a cross section of the second embodiment. The cross section illustrated in FIG. 4 of the third embodiment is similar to the cross section of the second embodiment as illustrated by the line A-A in FIG. 3.

The antenna element 5 in FIG. 4 comprises an inner section 49. The inner section 49 is arranged on the concave side 21 of the antenna assembly. The concave side 21 of the antenna assembly 1 is arranged opposite the convex side 19 of the antenna assembly. The elongate first section 27 of the antenna element 5 and the inner section 49 of the antenna element 5 are electrically connected to each other via a first connecting element 51. The first connecting element 51 is arranged in a first opening 53 formed in the structural section.

Further, the antenna assembly 1 shown in FIG. 4 comprises a second opening 55 formed in the structural section, wherein the second opening 55 extends from an outer surface 57 of the antenna assembly 1 to an inner surface 59 of the antenna assembly 1, wherein a third connecting element 61 is arranged in the second opening 55. The third connecting element 61 is electrically connected to the antenna element 5.

The structural section 3 in FIG. 4 comprises a first skin 63, a second skin 65, and a core 67. The first skin 63 is attached to the core 67 on a first side of the core 67 and the second skin 65 is attached to the core 67 on a second side of the core 67 opposite the first side of the core 67. At least a section of the first skin 63 forms at least a section of the convex outer surface 15 of the leading edge section 7.

Each of the antenna assemblies 1 described above can be manufactured by a method, which comprises providing a preform and the antenna element 5. The method further comprises positioning the preform and the antenna element 5 relative to each other such that the antenna element 5 is arranged in a recess of the preform. The method further comprises heating the preform and the antenna element 5 from a first temperature to a second temperature above a curing temperature of the preform to form the antenna assembly from the preform and the antenna element 5.

It is additionally pointed out that "comprising" does not rule out other elements, and "a" or "an" does not rule out a multiplicity. It is also pointed out that features that have been described with reference to one of the above exemplary embodiments may also be disclosed as in combination with other features of other exemplary embodiments described above. Reference signs in the claims are not to be regarded as restrictive.

The invention claimed is:

1. An elongate antenna assembly for an aircraft, comprising:

a structural section and an antenna element, wherein the structural section comprises an elongate leading edge section extending in a longitudinal direction of the antenna assembly, a first lateral section, and a second lateral section, wherein the leading edge section is curved such that the leading edge section comprises a convex outer surface extending in the longitudinal direction of the antenna assembly on a convex side of the antenna assembly, wherein the first lateral section extends away from the leading edge section on a first side of the leading edge section in a first direction transverse to the longitudinal direction of the antenna assembly, wherein the second lateral section extends away from the leading edge section on a second side of the leading edge section opposite the first side of the leading edge section in a second direction transverse to the longitudinal direction of the antenna assembly, wherein an elongate first recess is formed in the convex outer surface of the leading edge section on the convex side of the antenna assembly, wherein the first recess extends in the longitudinal direction of the antenna assembly, and wherein an elongate first section of the antenna element extends in the longitudinal direction of the antenna assembly and is arranged in the first recess, such that an outer surface of the elongate first section of the antenna element and the convex outer surface of the leading edge section form a first surface of the antenna assembly on the convex side of the antenna assembly.

2. The antenna assembly according to claim 1, wherein the first recess is formed in the convex outer surface of the leading edge section on the convex side of the antenna assembly such that at least a section of the leading edge section is arranged between the elongate first section of the antenna element and a concave side of the antenna assembly opposite the convex side of the antenna assembly.

3. The antenna assembly according to claim 1, wherein the antenna element comprises an inner section arranged on a concave side of the antenna assembly opposite the convex side of the antenna assembly, wherein the elongate first section of the antenna element and the inner section of the antenna element are electrically connected to each other via a first connecting element, wherein the first connecting element is arranged in a first opening formed in the structural section, and wherein the first section of the antenna element covers the first opening.

4. The antenna assembly according to claim 1, wherein an elongate second recess is formed in the first lateral section, wherein the second recess extends in the longitudinal direction of the antenna assembly, wherein an elongate second section of the antenna element extends in the longitudinal direction of the antenna assembly, and is arranged in the second recess, such that an outer surface of the elongate second section of the antenna element and an outer surface of the first lateral section form a second surface of the antenna assembly.

5. The antenna assembly according to claim 4, wherein the first section of the antenna element and the second section of the antenna element are electrically connected to each other via a second connecting element of the antenna element.

6. The antenna assembly according to claim 1, wherein the length of the antenna element from a first end of the antenna element to a second end of the antenna element is five (5) meters.

7. The antenna assembly according to claim 1, wherein a cross sectional area of the antenna element along the length of the antenna element from a first end of the antenna element to a second end of the antenna element is at least twenty (20) square millimeters.

8. The antenna assembly according to claim 1, further comprising:

at least one terminal electrically connected to the antenna element to provide an electrical connection between the antenna element and an external unit.

9. The antenna assembly according to claim 1, wherein the structural section comprises a first skin, a second skin, and a core, wherein the first skin is attached to the core on a first side of the core and the second skin is attached to the core on a second side of the core opposite the first side of the core, wherein at least a section of the first skin forms at least a section of the convex outer surface of the leading edge section.

10. The antenna assembly according to claim 1, wherein the structural section comprises a glass fiber reinforced polymer structure.

11. The antenna assembly according to claim 1, wherein the structural section comprises a carbon fiber reinforced polymer structure.

12. A vertical tail for an aircraft comprising the antenna assembly according to claim 1, wherein the first section of the antenna element forms a section of a leading edge of the vertical tail.

13. A horizontal tail for an aircraft comprising the antenna assembly according to claim 1, wherein the first section (of the antenna element forms a section of a leading edge of the horizontal tail.

14. A wing for an aircraft comprising the antenna assembly according to claim 1, wherein the first section of the antenna element forms a section of a leading edge of the wing.

15. An aircraft comprising the vertical tail according to claim 12.

16. A method for manufacturing the antenna assembly according to claim 1, comprising providing a preform and the antenna element, positioning the preform and the antenna element relative to each other such that the first section of the antenna element is arranged in a first recess of the preform, and heating the preform and the antenna element from a first temperature to a second temperature above a curing temperature of the preform to form the antenna assembly from the preform and the antenna element.

17. An antenna assembly according to claim 1, further comprising:

a structural section;

an antenna element, and a second opening formed in the structural section, wherein the second opening extends from an outer surface of the antenna assembly to an inner surface of the antenna assembly, wherein a third connecting element is arranged in the second opening, wherein the third connecting element is electrically connected to the antenna element, wherein the structural section comprises an elongate leading edge section extending in a longitudinal direction of the antenna assembly, a first lateral section, and a second lateral section, wherein the leading edge section is curved such that the leading edge section comprises a convex outer surface extending in the longitudinal direction of the antenna assembly on a convex side of the antenna assembly, wherein the first lateral section extends away from the leading edge section on a first side of the leading edge section in a first direction transverse to the longitudinal direction (of the antenna assembly, wherein the second lateral section extends away from the leading edge section on a second side of the leading edge section opposite the first side of the leading edge section in a second direction transverse to the longitudinal direction of the antenna assembly, wherein an elongate first recess is formed in the leading edge section on the convex side of the antenna assembly, wherein the first recess extends in the longitudinal direction of the antenna assembly, and wherein an elongate first section of the antenna element extends in the longitudinal direction of the antenna assembly and is arranged in the first recess, such that an outer surface of the elongate first section of the antenna element and the convex outer surface of the leading edge section form a first surface of the antenna assembly on the convex side (of the antenna assembly.

* * * * *